US005508698A

United States Patent [19]

Hoekman

[11] Patent Number: 5,508,698

[45] Date of Patent: Apr. 16, 1996

[54] VEHICLE DETECTOR WITH ENVIRONMENTAL ADAPTATION

[75] Inventor: Earl B. Hoekman, Roseville, Minn.

[73] Assignee: Minnesota Mining and Manufacturing Company, St. Paul, Minn.

[21] Appl. No.: 99,257

[22] Filed: Jul. 29, 1993

Related U.S. Application Data

[63] Continuation of Ser. No. 716,004, Jun. 17, 1991, abandoned.

[51] Int. Cl.[6] ..... G08G 1/01

[52] U.S. Cl. ..... 340/936; 340/933; 340/941; 364/438; 324/236

[58] Field of Search ..... 340/933, 934, 340/936, 938, 939, 941; 324/236, 207.23, 207.16, 179, 178, 175, 173, 655; 364/436, 437, 438

[56] References Cited

U.S. PATENT DOCUMENTS

| | | | |
|---|---|---|---|
| 3,609,679 | 9/1971 | Updegraff et al. | 340/941 |
| 3,685,013 | 8/1972 | Brickner | 340/939 |
| 3,943,339 | 3/1976 | Koerner et al. | 235/92 |
| 3,989,932 | 11/1976 | Koerner | 235/92 |
| 4,368,428 | 1/1983 | Dijkman | 324/178 |
| 4,369,427 | 1/1983 | Drebinger et al. | 340/941 |
| 4,379,280 | 4/1983 | Eshraghian et al. | 340/936 |
| 4,449,115 | 5/1984 | Koerner | 340/941 |
| 4,459,561 | 7/1984 | Clark et al. | 331/65 |
| 4,472,706 | 9/1984 | Hodge et al. | 340/941 |
| 4,491,841 | 1/1985 | Clark | 340/939 |
| 4,668,951 | 5/1987 | Duley et al. | 340/941 |
| 4,862,162 | 8/1989 | Duley | 340/938 |
| 4,873,494 | 10/1989 | Jefferis | 331/65 |
| 4,949,054 | 8/1990 | Briefer | 331/117 |
| 5,278,555 | 1/1994 | Hookman | 390/933 |

FOREIGN PATENT DOCUMENTS

| | | | |
|---|---|---|---|
| 0089030 | 9/1983 | European Pat. Off. | 340/941 |
| 2066539 | 7/1981 | United Kingdom . | |

*Primary Examiner*—John K. Peng
*Assistant Examiner*—Edward Lefkowitz
*Attorney, Agent, or Firm*—Gary L. Griswold; Walter N. Kirn; Kari H. Bartingale

[57] ABSTRACT

A reference value used in a vehicle detector is checked and adjusted. The vehicle detector determines the speed of a vehicle which it has detected and then makes a sample measurement after the vehicle has left the detection area of its inductive sensor. The timing of the measurement is based on the speed of the vehicle. The sample measurement is compared to the reference value, and adjustment of the reference value is made accordingly. In order to identify the cause of changes in the sensor drive oscillator signal frequency, the frequency of the oscillator signal is measured while connected to a dummy sensor not affected by vehicles. The reference value also is adjusted to reflect slow changes (drift) in sensor drive oscillator frequency. To identify changes in sensor drive oscillator frequency caused by mechanical difficulties which require maintenance activity to correct, a rate of frequency change of the sensor drive oscillator signal is determined over the plurality of measurement scanning segments.

13 Claims, 2 Drawing Sheets

VEHICLE DETECTOR WITH ENVIRONMENTAL ADAPTATION

This is a continuation of application Ser. No. 07/716,004, filed Jun. 17, 1991, now abandoned.

BACKGROUND OF THE INVENTION

The present invention relates to vehicle detectors which detect the passage or presence of a vehicle over a defined area of a roadway. In particular, the present invention relates to improved methods of environmental adaption of vehicle detectors.

Inductive sensors are used for a wide variety of detection systems. For example, inductive sensors are used in systems which detect the presence of conductive or ferromagnetic articles within a specified area. Vehicle detectors are a common type of detection system in which inductive sensors are used.

Vehicle detectors are used in traffic control systems to provide input data required by a controller to control signal lights. Vehicle detectors are connected to one or more inductive sensors and operate on the principle of an inductance change caused by the movement of a vehicle in the vicinity of an inductive sensor. The inductive sensor can take a number of different forms, but commonly is a wire loop which is buried in the roadway and which acts as an inductor.

The vehicle detector generally includes circuitry which operates in conjunction with the inductive sensor to measure changes in inductance and to provide output signals as a function of those inductance changes. The vehicle detector includes an oscillator circuit which produces an oscillator output signal having a frequency which is dependent on sensor inductance. The sensor inductance is in turn dependent on whether the inductive sensor is loaded by the presence of a vehicle. The sensor is driven as a part of a resonant circuit of the oscillator. The vehicle detector measures changes in inductance in the sensor by monitoring the frequency of the oscillator output signal.

Examples of vehicle detectors are shown, for example, in U.S. Pat. No. 3,943,339 (Koerner et al.) and in U.S. Pat. No. 3,989,932 (Koerner).

Detection of a vehicle is accomplished by comparing a measured value based on the oscillator frequency to a reference value. The reference value should be equivalent to the measured value when the sensor area is unoccupied. If the vehicle detector has an incorrect reference value, errors in detection may occur. These errors may result in vehicles over the sensor not being detected, vehicles being detected when the sensor area is actually empty, and a single vehicle being detected as multiple vehicles.

Vehicle detectors in use today use relatively blind approaches to adjusting the reference value in an attempt to track oscillator frequency changes caused by the environment rather than by vehicles. The methods of adjusting the reference value utilized in prior art detectors include: adjusting the reference value toward the current measurement value by a fixed amount during each fixed time interval; adjusting the reference value toward the current frequency measurement value by a fraction of the difference between the two during each fixed time interval; adjusting the reference value immediately to the current measurement value if the current frequency decreases for a predetermined amount of time; utilizing an alternative amount of adjustment of the reference value per fixed time interval when a vehicle is over the sensor; and setting the reference value to the current measurement value a fixed amount of time after the vehicle is no longer detected. Prior art vehicle detectors use various combinations of these approaches. An example of environmental tracking in vehicle detectors is U.S. Pat. No. 4,862,162 (Duley). Each of these approaches results in a high probability that the reference value will be set to the wrong value, particularly during heavy traffic when it is most important that it be set correctly.

SUMMARY OF THE INVENTION

The present invention is a combination of methods for adjusting the reference value to compensate for oscillator frequency changes caused by the environment rather than by vehicles. The methods use a check of the vehicle detector reference value immediately following initialization or whenever it is deemed appropriate. This check will be useful, for example, in correcting errors occurring because the detector was initialized with a vehicle over the sensor. The methods also provide for adjustment of the reference value to reflect slow changes in the oscillator frequency caused by the environment. The cause of the changes in the oscillator signal may be identified by using a dummy sensor, which is unaffected by the presence of a vehicle, to determine whether the change is due to temperature or humidity as opposed to environmental changes external to the detector. Additionally, the methods identify changes in oscillator frequency caused by mechanical difficulties which require maintenance activity to correct.

Figure 1:
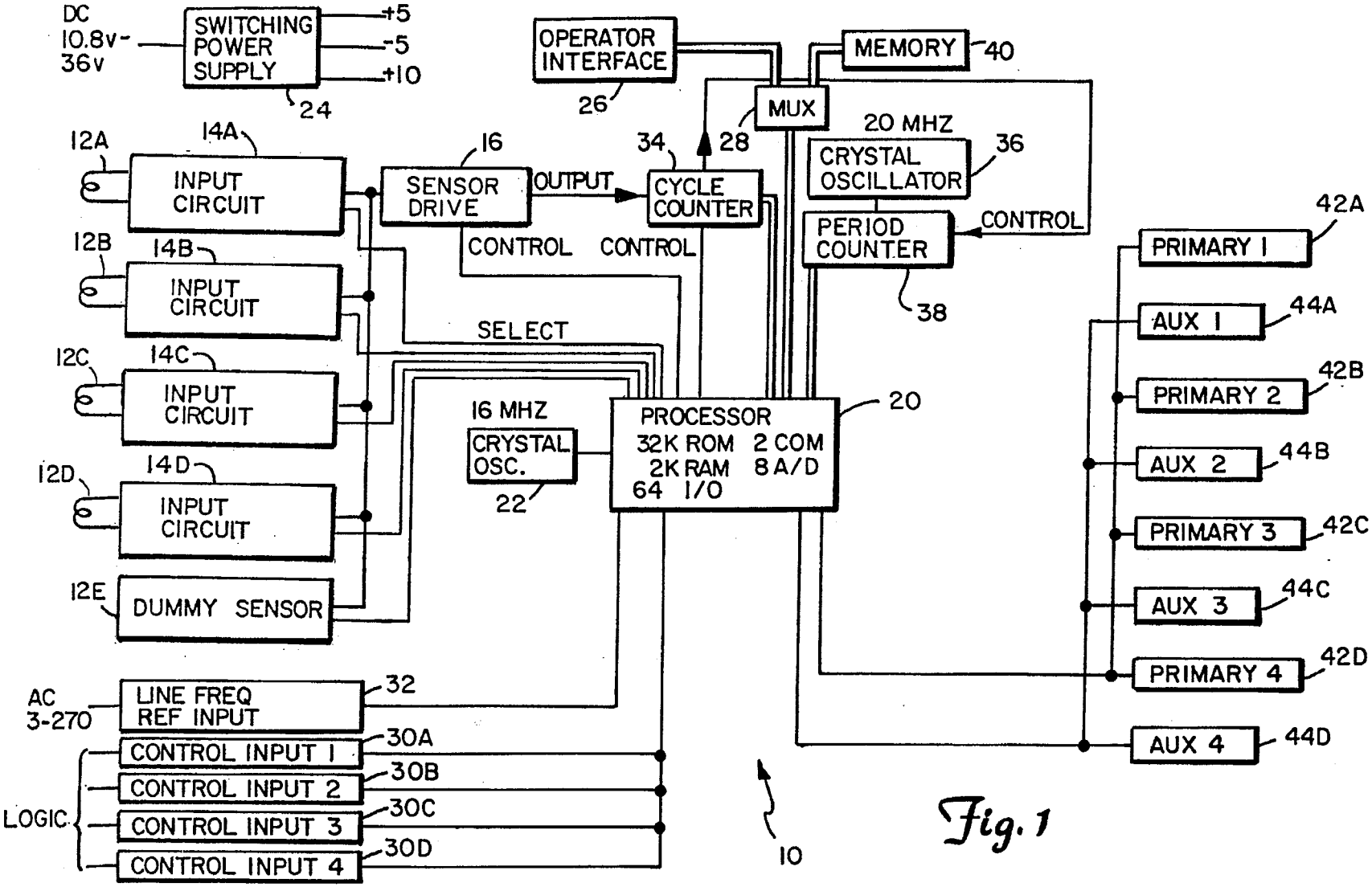
FIG. 1 is a block diagram of an inductive sensor vehicle detector which is capable of utilizing the environmental adaptation methods.

DETAILED DESCRIPTION OF THE PREFERRED EMBODIMENTS (1) General System Description Vehicle detector 10 shown in FIG. 1 is a four channel system which monitors the inductance of inductive sensors 12A, 12B, 12C and 12D. Each inductive sensor 12A–12D is connected to an input circuit 14A–14D, respectively. Sensor drive oscillator 16 is selectively connected through input circuits 14A–14D to one of the inductive sensors 12A–12D to provide a drive current to one of the inductive sensors 12A–12D. The particular inductive sensor 12A–12D which is connected to oscillator 16 is based upon which input circuit 14A–14D receives a sensor select signal from digital processor 20. Sensor drive oscillator 16 produces an oscillator signal having a frequency which is a function of the inductance of the inductive sensors 12A–12D to which it is connected.

As also shown in FIG. 1, dummy sensor 12E is provided and is connected to sensor drive oscillator 16 in response to a select signal from digital processor 20. Dummy sensor 12E has an inductance which is unaffected by vehicles, and therefore provides an indication of need for adjustment or correction of the values measured by inductive sensors 12A–12D.

The overall operation of vehicle detector 10 is controlled by digital processor 20. Crystal oscillator 22 provides a high frequency clock signal for operation of digital processor 20. Power supply 24 provides the necessary voltage levels for operation of the digital and analog circuitry within the vehicle detector 10.

Digital processor 20 receives inputs from operator interface 26 (through multiplexer 28), and receives control inputs from control input circuits 30A–30D. In a preferred embodiment, control input circuits 30A–30D receive logic signals, and convert those logic signals into input signals for processor 20.

Processor 20 also receives a line frequency reference input signal from line frequency reference input circuit 32. This input signal aids processor 20 in compensating signals from inductive sensors 12A–12D for inductance fluctuations caused by nearby power lines.

Cycle counter 34, crystal oscillator 36, period counter 38, and processor 20 form detector circuitry for detecting the frequency of the oscillator signal. Counters 34 and 38 may be discrete counters (as illustrated in FIG. 1) or may be fully or partially incorporated into processor 20.

In a preferred embodiment of the present invention, digital processor 20 includes on-board read only memory (ROM) and random access memory (RAM) storage. In addition, non-volatile memory 40 stores additional data such as operator selected settings which is accessible to processor 20 through multiplexer 28.

Vehicle detector 10 has four output channels, one for each of the four sensors 12A–12D. The first output channel, which is associated with inductive sensor 12A, has a primary output circuit 42A, and an auxiliary output circuit 44A. Similarly, primary output circuit 42B and auxiliary output circuit 44B are associated with inductive sensor 12B and form the second output channel. The third output channel includes primary output circuit 42C and auxiliary output circuit 44C, which are associated with inductive sensor 12C. The fourth channel includes primary output circuit 42D and auxiliary output circuit 44D, which are associated with inductive sensor 12D.

Processor 20 controls the operation of primary output circuits 42A–42D, and also controls the operation of auxiliary output circuits 44A–44D. The primary output circuits 42A–42D provide an output which is conductive even when vehicle detector 10 has a power failure. The auxiliary output circuits 44A–44D, on the other hand, have outputs which are non-conductive when power to vehicle detector 10 is off.

In operation, processor 20 provides sensor select signals to input circuits 14A–14D to connect sensor drive oscillator 16 to inductive sensors 12A–12D in a time multiplexed fashion. Similarly, a sensor select signal to dummy sensor 12E causes it to be connected to sensor drive oscillator 16. Processor 20 also provides a control input to sensor drive oscillator 16 to select alternate capacitance values used to resonate with the inductive sensor 12A–12D or dummy sensor 12E. When processor 20 selects one of the input circuits 14A–14D or dummy sensor 12E, it also enables cycle counter 34. As sensor drive oscillator 16 is connected to an inductive load (e.g., input circuit 14A and sensor 12A) it begins to oscillate. The oscillator signal is supplied to cycle counter 34, which counts oscillator cycles. After a brief stabilization period for the oscillator signal to stabilize, processor 20 enables period counter 38, which counts in response to 1a very high frequency (e.g., 20 MHz) signal from crystal oscillator 36.

When cycle counter 34 reaches a predetermined number ($N_{seg}$) of oscillator 16 cycles after oscillator stabilization, it provides a control signal to period counter 38, which causes period counter 38 to stop counting. The period count is then representative of the period of the oscillator signal from oscillator 16 during one measurement frame segment. After the completion of each measurement frame segment, processor 20 produces a total measurement frame time duration representative of a predetermined number M of measurement frame segment period counts. The M period counts are taken during the current measurement frame segment and M minus one (e.g., three when M is equal to four) past measurement frame segments for that particular inductive sensor; with the M measurement frame segments together constituting a single measurement frame. Processor 20 compares a "measurement value" (total measurement frame time duration $T_{FRAME}$) to a "reference value" (reference time duration $T_{REF}$), calculated with no vehicle near the inductive sensor, and a difference is calculated. A change in the count which exceeds a predetermined threshold, $\Delta T_{Thresh}$, indicates the presence of a vehicle near inductive sensor 12A–12D.

(2) Reference Value Initialization Check

In the following discussion, changes in the oscillator signal caused by an inductance change of a sensor 12A–12D will be discussed in terms of period (T) rather than frequency (f). This is simply a matter of convenience for mathematical expression. Frequency is equal to the inverse of period (i.e., f=1/T). Frequency is inversely related to sensor inductance (L) while period is directly related to inductance (i.e., an increase in inductance causes an increase in period).

Figure 2:
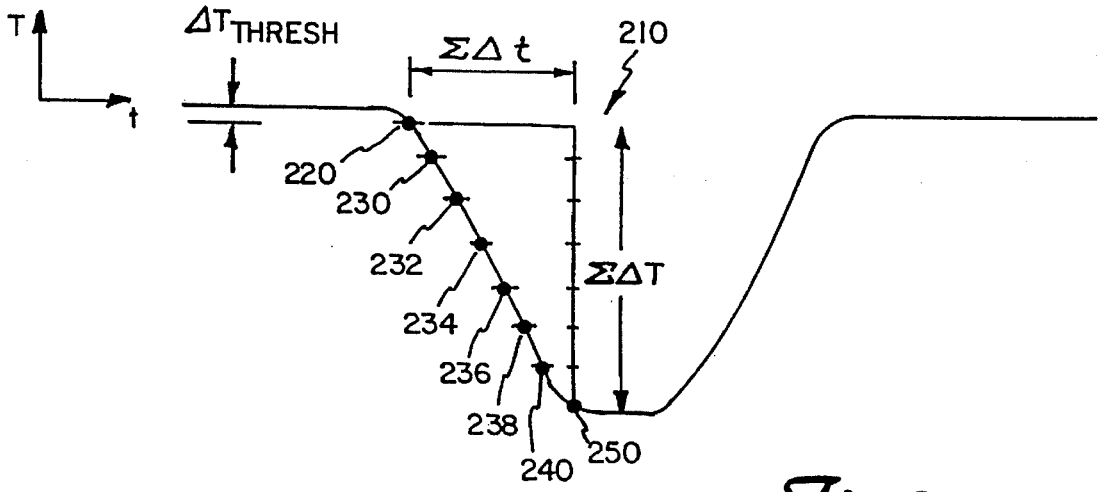
FIG. 2 is a graph illustrating measured period (T) of the oscillator signal as a function of time (t) as a vehicle passes through a detection area associated with the inductive sensor.

Vehicle detector 10 receives a user settable sensor entry distance $d_{entry}$, which represents the distance a vehicle must travel to fully enter the sensor area. In the present embodiment, $d_{entry}$ is assumed to be a constant for vehicles longer than the loop. FIG. 2 is a graph of measurement value (period T) as a function of time. Individual measurement values are designated by points 220, 230, 232, 234, 236, 238, 240 and 250. As illustrated in FIG. 2, processor 20 monitors the measurement values for a minimum threshold change $\Delta T_{Thresh}$ which would indicate the initial presence of a vehicle over the inductive sensor. The required change $\Delta T_{Thresh}$ has occurred at point 220. Once a vehicle has been detected, processor 20 determines and stores the change in period ΔT of the sensor drive oscillator signal over each of a plurality of measurement frame segments corresponding to the sensor (12A, 12B, 12C or 12D) over which the vehicle was detected. The period measured during a plurality of measurement frame segments is illustrated by points 230, 232, 234, 236, 238, 240 and 250. Processor 20 also determines and stores a magnitude of change in sensor drive oscillator period $\Delta T_{MAX}$ 250 and the time at which it occurs. $\Delta T_{MAX}$ has been found to correspond to a reasonable estimate of the inductance change that reflects both the time required for the vehicle to enter the sensor detection area and the presence of the vehicle in the sensor detection area. These measurements are used in detecting vehicle speed.

If the number of measurement frame segments that occur between the detection of a threshold change in period $\Delta T_{Thresh}$ and the magnitude of change in period $\Delta T_{MAX}$ is equal to a predetermined number, e.g. five or more, then processor 20 makes a speed measurement calculation. The number five has been chosen to ensure reasonable accuracy. A number larger than five would increase detector accuracy. In this embodiment, if the number of measurement frame segments is less than five, then no speed measurement calculations are performed.

Also as illustrated in FIG. 2, processor 20 next estimates the time rate of period change dT/dt of the sensor drive oscillator signal by summing the changes in period ΔT for each measurement frame segment between the detection of $\Delta T_{Thresh}$ and $\Delta T_{MAX}$, and dividing the summation by the total time elapsed during those measurement frame segments.

$$\frac{dT}{dt} = \frac{\Sigma \Delta T_i}{\Sigma \Delta t_i} \quad \text{Eq. 1}$$

Processor 20 then calculates the entry time ET for this particular vehicle, where ET is equal to the maximum change in period $\Delta T_{MAX}$ divided by dT/dt.

$$ET = \frac{\Delta T_{MAX}}{\frac{dT}{dt}} \quad \text{Eq. 2}$$

Processor 20 next calculates vehicle speed which is equal to the entry distance $d_{entry}$ divided by the vehicle entry time ET.

$$S = \frac{d_{entry}}{ET} \quad \text{Eq. 3}$$

After determining vehicle speed, processor 20 estimates the time, based upon the measured vehicle speed, at which the vehicle will have sufficiently exited the sensor area so as to have substantially no influence on the frequency of the oscillator signal. At the time that was determined to be sufficient for the vehicle to have exited the sensor area, a sample period measurement value $T_{SAMPLE}$ is measured and then compared to the reference value $T_{REF}$. The following equation illustrates one method of making the comparison and subsequent adjustment of $T_{REF}$:

$$T_{SAMPLEAV} = \frac{k^* \sum_{i=1}^{N} (T_{SAMPLEi} - T_{REFi})}{N} \quad \text{Eq. 4}$$

where, k=a constant $T_{SAMPLEi}$=the $i^{th}$ sample value measured $T_{REFi}$=the reference period value corresponding to $T_{SAMPLEi}$ $T_{SAMPLEAV}$=average difference betwen $T_{SAMPLE}$ and $T_{REF}$ N=the number of samples taken=a function of the difference between $T_{SAMPLE}$ and $T_{REF}$ If $T_{SAMPLE}$ minus $T_{REF}$ is greater than a predetermined value P, $T_{REF}$ will be adjusted to equal $T_{SAMPLEAV}$ using N=1 and k≈1. In other words, $T_{REF}$ is set to $T_{SAMPLE}$ in this case.

If the difference between $T_{REF}$ and $T_{SAMPLE}$ is less than P, then detector 10 takes a larger number of additional sample measurements (e.g. N=4), each after a different vehicle is determined to have completed a pass over the sensor area. The additional sample measurements are then compared. If samples are consistent, as defined by a predetermined range, processor 20 calculates $T_{SAMPLEAV}$ according to the above formula. The reference value $T_{REF}$ is then adjusted to equal the average sample value $T_{SAMPLEAV}$.

(3) Identification of Temperature and Humidity Caused Changes in Oscillator Frequency Processor 20 provides a sensor select signal to dummy sensor 12E, causing it to be connected to sensor drive oscillator 16. The frequency of sensor drive oscillator 16 is then measured while connected to dummy sensor 12E. Processor 20 next compares the measured frequency $F_{MDS}$ (or period $T_{MDS}$) to a previously measured frequency $F_{PDS}$ (or period $T_{PDS}$) of dummy sensor 12E.

Since the effects of temperature and humidity on dummy sensor 12E can be measured and calibrated, and since only temperature and humidity may have an affect on the oscillator frequency while connected to dummy sensor 12E, these measurements provide a means for identifying environmental changes. Changes in temperature and humidity, which affect sensors 12A–12D as well as dummy sensor 12E, will be identifiable and the reference frequency may be adjusted accordingly. If no change in dummy sensor frequency is detected, processor 20 will be able to determine that any environmental effects on the sensor drive oscillator signal while connected to sensors 12A–12D, are due to environmental changes other than temperature and humidity effects on detector components, and therefore are likely external to vehicle detector 10.

Note that dummy sensor 12E is used as a means of identifying environmental changes which affect oscillator frequency. It is not used directly as a means of adjusting the reference value $T_{REF}$ because external environmental changes may offset the effects of temperature and humidity on detector components.

(4) Identification of Changes in Oscillator Frequency Caused by Mechanical Difficulties or External Interference This method may be utilized to identify changes in sensor drive oscillator frequency caused by mechanical difficulties, rather than by a vehicle or other environmental changes, and which require maintenance activity to permanently eliminate. Vehicle detector 10 measures the frequency change ΔF (or period change ΔT) of the sensor drive oscillator signal over each of a plurality of measurement frame segments. Next, processor 20 measures the rate of change dF/dt (or dT/dt) of the sensor drive oscillator signal by summing the measured changes in frequency ΔF (or period ΔT) for each of the plurality of measurement frame segments, and dividing the summation by the total time elapsed during those measurement periods.

$$\frac{dF}{dt} = \frac{\Sigma \Delta F_i}{\Sigma \Delta t_i} \quad \text{Eq. 5A}$$

or $$\frac{dT}{dt} = \frac{\Sigma \Delta T_i}{\Sigma \Delta t_i} \quad \text{Eq. 5B}$$

The rate of frequency change dF/dt or period change dT/dt caused by mechanical difficulties or external interference is normally much greater than the rate of change caused by vehicles or by other environmental changes. In practice, the maximum time rate of change of inductance of a sensor which will be caused by a vehicle is approximately 500 nh/millisec. The corresponding maximum dF/dt or dT/dt for a particular vehicle detector will depend on the particular sensor and oscillator circuit used.

Processor 20 monitors the measured rate of change dF/dt (or dT/dt) of the sensor drive oscillator signal for a rate of change greater than a threshold rate of change. Measurement of a rate of change surpassing the threshold rate of change is indicative of mechanical difficulties. Upon measurement of a rate of change indicative of mechanical difficulties, processor 20 takes a predetermined number of sample frequency measurements $F_{SAMPLE}$. If successive $F_{SAMPLE}$ measurements indicate a permanent change in frequency F after the excessive dF/dt, the detector will reinitialize the channel and attempt to reestablish $T_{REF}$. Processor 20 does, however, record the occurrence as an indication of mechanical difficulties to unit operators.

(5) Adjustment of Reference For Drift

This method may be utilized to adjust the reference value of a vehicle detector to reflect slow changes (drift) in oscillator frequency caused by the environment. During initialization, processor 20 conservatively calculates a maximum measurement period $T_{measmax}$ which is used to prevent the classification of anticipated drift as vehicle presence. This value $T_{measmax}$ could alternatively be stored as a constant in the ROM of processor 20. In this embodiment, $T_{measmax}$ is calculated as follows:

$$T_{measmax} = \frac{16 * T_{cry}}{(\Delta T_{Sdriftmax} + \Delta T_{Ddriftmax}) * \Delta t} \quad \text{Eq. 6A}$$

When $\Delta t \approx 4T_{measmax}$ as would be the case in a four channel detector, Eq. 6A becomes:

$$T_{measmax} = \sqrt{\frac{16 * T_{cry}}{(\Delta T_{Sdriftmax} + \Delta T_{Ddriftmax}) * 4}} \quad \text{Eq. 6B}$$

where, $\Delta t$=time between successive measurement starts or stops $T_{cry}$=the period of crystal oscillator 36 which is being counted to measure sensor drive oscillator frequency.

$\Delta T_{Sdriftmax}$=the maximum drift rate expressed as a fraction of sensor drive oscillator period caused by the sensor and other components exterior to the detector.

$\Delta T_{Ddriftmax}$=the maximum drift rate expressed as a fraction of sensor drive oscillator period caused by components internal to the detector.

$$\text{If } \Delta T_{Sdriftmax} + \Delta T_{Ddriftmax} > \frac{10^{-5}}{\text{second}},$$

$$\text{then } T_{measmax} = 141 \text{ millisec}$$

Use of a dummy sensor allows the direct measurement of actual oscillator drift. This allows longer $T_{measmax}$ values than shown above, because in this case, only external drift rates need to be accommodated, e.g. $\Delta T_{Ddriftmax}$=0 may be used in Eqs. 6A or 6B.

During normal operation, detector 10 measures the change in period $\Delta T$ of the sensor drive oscillator signal during each successive maximum measurement period $T_{measmax}$. Processor 20 then compares the change in period $\Delta T$, measured during $T_{measmax}$, to a threshold change in period of $\Delta T_{Thresh}$.

If the change in period $\Delta T$ over the maximum measurement period $T_{measmax}$ is less then $\Delta T_{Thresh}$, then the reference value $T_{REF}$ is adjusted by adding the change in period $\Delta T$:

$$\text{If } \Delta T < \Delta T_{Thresh}, \text{ then } T_{REF1} = \Delta T + T_{REF}$$

where, $$F_{REF1} = \frac{1}{T_{REF}} \quad \text{Eq. 7}$$

If the change in period $\Delta T$ is greater than $\Delta T_{Thresh}$, the reference frequency is not adjusted.

CONCLUSION

The present invention makes adjustments to the reference value used in a vehicle detector only when there are indications that a change caused by environmental factors has occurred. Shifts in measured values caused by mechanical problems or by other causes which may not be correctable by a change in reference value are identified.

Although the present invention has been described with reference to preferred embodiments, workers skilled in the art will recognize that changes may be made in form and detail without departing from the spirit and scope of the invention.

What is claimed is:

1. In a vehicle detector having a processor and in which vehicles are detected by an inductive sensor forming a part of an oscillator, and a change in the period of an oscillator signal is indicative of the presence of a vehicle in a detection area associated with the inductive sensor, a method comprising the processor implemented steps of:

monitoring the oscillator signal period to produce a corresponding measurement value;

detecting entry of a vehicle into the detection area and detecting exit of the vehicle from the detection area based upon changes in the measurement value with respect to a reference value;

determining the speed of the vehicle;

calculating a time after the vehicle exits from the detection area at which the vehicle will not influence the period of the oscillator signal, wherein the time calculation is based upon the vehicle speed and upon a predetermined distance from the detection area;

producing a sample measurement value at the calculated time after vehicle exit from the detection area;

comparing the reference value and the sample measurement value; and adjusting the reference value based upon the comparison, so as to adapt the vehicle detector to environmental changes.

2. The method of claim 1 wherein the calculating the time after the vehicle exits from the detection area further comprises the processor implemented steps of:

determining a time rate of change of inductance of the inductive sensor;

determining a magnitude of change of inductance; and calculating vehicle speed based upon a predetermined entry distance and a ratio of the magnitude of change in inductance and the time rate of change.

3. The method of claim 1 wherein the step of adjusting the reference value further comprises the processor implemented step of setting the reference value equal to the sample measurement value if the difference between the reference value and the sample measurement value is greater than a predetermined threshold.

4. The method of claim 1 further comprising the processor implemented step of setting the reference value equal to an average of a plurality of sample measurement values, each measured after a vehicle has exited the detection area.

5. A method of checking a reference value used in an inductive sensor vehicle detector having a processor, comprising the processor implemented steps of:

measuring frequency of an oscillator signal to produce a measurement value which is a function of inductance of the inductive sensor;

indicating presence of a vehicle if a difference between the measurement value and the reference value exceeds a threshold value;

measuring vehicle speed of the vehicle passing through a sensor area associated with the inductive sensor, the vehicle speed measurement based upon a rate of frequency change and a magnitude of frequency change of the oscillator signal caused by the vehicle;

determining a time after the vehicle exits from the sensor area, based upon the vehicle speed and upon a predetermined distance from the sensor area, at which the vehicle will have traveled the predetermined distances from the sensor area so, wherein the predetermined distance is chosen such that the vehicle will have substantially no influence on the frequency of the oscillator signal;

taking a sample measurement of the frequency of the oscillator at the time after the vehicle exits from the sensor area; and adjusting the reference value based upon the sample measurement, so as to adapt the vehicle detector to environmental changes.

6. The method of claim 5 wherein the step of adjusting the reference value comprises the processor implemented steps of:

determining a difference between a first sample measurement value and the reference value;

adjusting the reference value to the first sample measurement value if a difference between them is greater than a predetermined level;

producing a predetermined number of additional sample measurement values, each after a vehicle has been determined to have completed a pass through the detection area;

comparing the sample measurement values to determine whether the measurement values are within a predetermined range;

averaging the sample measurement values to produce an average sample measurement value; and adjusting the reference value to the average sample measurement value if comparing shows the sample measurement values are within said predetermined range.

7. In a vehicle detector having a processor, wherein the vehicle detector senses presence of a vehicle with an inductive sensor, a method of identifying environmental changes which affect the vehicle detector, comprising the processor implemented steps of:

measuring inductance of a dummy sensor which is unaffected by the presence of a vehicle;

comparing a currently measured inductance of the dummy sensor to a previously measured inductance of the dummy sensor; and determining, based upon the comparison of the currently and previously measured dummy sensor inductances, a change therebetween;

identifying, based on the change between the currently and previously measured dummy sensor inductances, environmental changes which affect the vehicle detector.

8. In a vehicle detector having a processor and in which an inductive sensor changes inductance in response to a vehicle, and in which an oscillator is connected to the inductive sensor to produce an oscillator signal having a frequency which is a function of inductance of the inductive sensor, a method of identifying a cause of changes in the oscillator signal frequency which are not caused by presence of a vehicle, the method comprising the processor implemented steps of:

connecting the oscillator to a dummy sensor having an inductance which is not affected by vehicles;

measuring the frequency of an oscillator signal while the oscillator is connected to the dummy sensor;

comparing the frequency measured to a previously measured frequency of the dummy sensor; and determining, based upon the comparing, a change in the measured frequency;

identifying, based on the change in measured frequency, environmental changes which affect the vehicle detector.

9. In a vehicle detector having a processor and in which a first threshold rate of change in inductance of an inductive sensor indicates vehicle presence, a method of identifying changes in the inductance of the inductive sensor caused by mechanical difficulties rather than by a vehicle, the method comprising the processor implemented steps of:

setting a second threshold rate of change in inductance of the inductive sensor that is indicative of mechanical difficulties, wherein the second threshold rate of change is greater than the first threshold rate of change;

measuring the inductance of the inductive sensor over a plurality of measurement frame segments;

calculating a time rate of change of inductance of the inductive sensor; and identifying mechanical difficulties with the vehicle detector when the time rate of change of inductance calculated is at least equal to the second threshold rate of change.

10. In an inductive sensor system having a processor and in which an inductive sensor is connected to an oscillator to produce an oscillator signal having a frequency which is a function of inductance of the inductive sensor, a method of identifying changes in frequency of the oscillator signal which are not produced in normal operation, and are caused by mechanical difficulties which require maintenance activity to correct, the method comprising the processor implemented steps of:

measuring a change in frequency of the oscillator signal over each of a plurality of measurement frame segments;

calculating a rate of frequency change dF/dt of the oscillator signal over the plurality of measurement frame segments;

determining whether the rate of frequency change dF/dt corresponds to a rate which does not occur during normal operations, and is, therefore, indicative of mechanical difficulties; and providing a signal indicating existence of mechanical difficulties.

11. A method of adjusting a reference value of a vehicle detector having a processor and which compares a measured value derived from an inductive sensor to a reference value, the method comprising the processor implemented steps of:

calculating a plurality of measurement periods;

measuring a change in the measured value during each of said plurality of measurement periods;

comparing the change in each said measured value to a threshold change; and producing a new reference value based upon an average change in said measured values and the threshold change, so as to adapt the vehicle detector to drift in the measured value.

12. The method of claim 11 wherein the step of producing a new reference value further comprises the processor implemented step of adding the average change in the measured values to the reference value if the average change in the measured values is less than the threshold change.

13. In a vehicle detector having a processor and in which an inductive sensor is connected to an oscillator to produce an oscillator signal having a frequency which is a function of inductance of the inductive sensor, and in which presence of a vehicle is determined by comparing a measurement value which is a function of oscillator signal frequency to a reference value; a method of adjusting the reference value of a vehicle detector to compensate for drift in oscillator frequency, the method comprising the processor implemented steps of:

estimating maximum drift rates in the measurement values caused by the inductive sensor and vehicle detector components as a fraction of an oscillator period during a maximum time period;

measuring a change in the measurement value during a maximum time period;

comparing the change in the measurement value to a threshold change in value; and producing a new reference value, if the change in the measurement value was less than the threshold change by adding a fraction of the change to the reference value, so as to adapt the vehicle detector to drift in the oscillator frequency.

* * * * *